US008157628B2

(12) United States Patent
Villela et al.

(10) Patent No.: US 8,157,628 B2
(45) Date of Patent: Apr. 17, 2012

(54) BAFFLED ROLL VENT

(75) Inventors: Edward C. Villela, Leonia, NJ (US); Adem Chich, Kearny, NJ (US)

(73) Assignee: Building Materials Investments Corporation, Wilmington, DE (US)

( * ) Notice: Subject to any disclaimer, the term of this patent is extended or adjusted under 35 U.S.C. 154(b) by 1015 days.

(21) Appl. No.: 11/385,598

(22) Filed: Mar. 21, 2006

(65) Prior Publication Data

US 2006/0229010 A1 Oct. 12, 2006

Related U.S. Application Data

(63) Continuation-in-part of application No. 11/069,127, filed on Mar. 1, 2005, now Pat. No. 7,537,518.

(51) Int. Cl.
*F24F 7/00* (2006.01)
*E04B 7/00* (2006.01)

(52) U.S. Cl. ..... 454/365; 52/198

(58) Field of Classification Search ..... 454/365; 52/198

See application file for complete search history.

(56) References Cited

U.S. PATENT DOCUMENTS

| | | | |
|---|---|---|---|
| 3,185,070 | A | 5/1965 | Smith |
| 3,236,170 | A | 2/1966 | Meyer et al. |
| 3,660,955 | A | 5/1972 | Simon |
| 3,949,657 | A | 4/1976 | Sells |
| 4,280,399 | A | 7/1981 | Cunning |
| 4,676,147 | A | 6/1987 | Mankowski |
| 4,817,506 | A | 4/1989 | Cashman |
| 4,843,953 | A | 7/1989 | Sells |
| 4,899,505 | A | 2/1990 | Williamson et al. |
| 4,903,445 | A | 2/1990 | Mankowski |
| 4,924,761 | A | 5/1990 | MacLeod et al. |
| 4,957,037 | A | 9/1990 | Tubbesing et al. |
| 5,009,149 | A | 4/1991 | MacLeod et al. |
| 5,052,286 | A | 10/1991 | Tubbesing et al. |
| 5,060,431 | A | 10/1991 | MacLeod et al. |
| 5,070,771 | A | 12/1991 | Mankowski |
| 5,092,225 | A | 3/1992 | Sells |
| 5,095,810 | A | 3/1992 | Robinson |
| 5,112,278 | A | 5/1992 | Roberts |
| 5,122,095 | A | 6/1992 | Wolfert |
| 5,149,301 | A | 9/1992 | Gates |
| 5,167,579 | A | 12/1992 | Rotter |
| 5,457,920 | A | 10/1995 | Waltz |
| 5,458,538 | A | 10/1995 | MacLeod et al. |
| 5,600,928 | A | 2/1997 | Hess et al. |
| 5,704,834 | A | 1/1998 | Sells |
| 5,772,502 | A | 6/1998 | Smith |
| 6,227,963 | B1 | 5/2001 | Headrick |
| 6,233,887 | B1 | 5/2001 | Smith |
| 6,260,315 | B1 | 7/2001 | Smith |
| 6,599,184 | B2 | 7/2003 | Morris |
| 6,684,581 | B2 | 2/2004 | Robinson et al. |
| 7,024,828 | B2 | 4/2006 | Headrick |
| 2004/0088928 | A1 * | 5/2004 | Headrick et al. ..... 52/98 |
| 2004/0088932 | A1 | 5/2004 | Headrick |

* cited by examiner

*Primary Examiner* — Steven B McAllister
*Assistant Examiner* — Helena Kosanovic
(74) *Attorney, Agent, or Firm* — Sills Cummins & Gross P.C.

(57) ABSTRACT

A baffled roll vent for covering the ridge slot of a roof for allowing ventilation from the space of a building below the ridge slot, the baffled roll vent having a first vent section having a male part and a second vent section having a female part, wherein the male part of the first vent section attaches to the female part of the second vent section. The male and female parts are preferably located at opposite edges of each vent section, allowing each vent section in the baffled roll vent to attach to the next vent section in the baffled roll vent. A center hinge allows flexing of the panel to conform to the pitch of a roof.

20 Claims, 15 Drawing Sheets

BAFFLED ROLL VENT

CROSS REFERENCE TO RELATED PATENT APPLICATION

This application is a continuation-in-part of U.S. patent application Ser. No. 11/069,127, filed Mar. 1, 2005 now U.S. Pat. No. 7,537,518.

BACKGROUND OF THE INVENTION

1. Field of the Invention

The present invention relates to vents for covering an opening at a peak of a roof. More particularly, the invention relates to baffled roll vents comprised of a unitary panel capable of rolling into a coil configuration prior to installation, and capable of unfolding to lay flat on the roof ridge at installation.

2. Background

Vents for attics of residential or commercial buildings are commonly perforated or have baffled openings in the underside of the eaves of an overhanging roof or fascia and on the roof ridge overlaying the open roof along the length of the roof. The vent openings allow air to flow into the attic to equalize the interior attic temperature and pressure with that of the outside environment. The equalization helps to control attic temperature and reduces the accumulation of condensation in the attic thereby increasing the efficiency of heating and cooling of the living space in the building covered by the roof structure.

A roof ridge ventilator overlays a roof ridge slot along the length of the roof. The roof ventilator is for exhausting air from the space below the roof and above the floor of the attic.

Ventilation systems should provide against insects and other unwanted elements entering the attic space of buildings. While larger perforations in soffit and roof ridge ventilation panels produce a desired flow of air through the attic space, they also allow ingress to insects. In addition to having good ventilation of the attic space and preventing ingress of water, snow and insects into the attic space, ventilation systems should have structural strength and stability to withstand the effects of the elements, including high wind; strong structural support against collapse or warping, such as might occur by the accumulation of snow or ice or by weight of the installers accidentally stepping on the roof ridge ventilator; ease of installation; and low costs.

The present invention is directed to roof ridge vents that preferably are used in conjunction with an adequate soffit ventilator of the prior art.

SUMMARY OF THE INVENTION

In accordance with the present invention, a baffled roll vent is provided that is manufactured from flexible polymer compounds. The vent is spirally rollable for easy handling and installation. The baffled roll vent is for covering the ridge of a roof having an opening therein or ridge slot providing for the flow of air from the space below the roof ridge to the outside environment while preventing entry of water and other unwanted elements.

The ridge vent preferably comprises a unitary plastic panel that is disposed over the ridge of the roof covering the ridge slot as well as overlapping portions of the roof shingles adjacent to the ridge slot. The plastic panel may not be integrally unitary but instead may comprise substantially fluid tight hinges connecting partitions into a unitary piece.

The panel is flexible and can be contoured to roofs having from 0 degree to 45 degree slope at the peak or more. The panel can be contoured at a center line where a hinge is incorporated. Also a hinge may be incorporated at two parallel lines spaced from the central point line running longitudinally of the panel. These hinges provide flexibility in the panel. The panel has a topside or surface facing the exterior and an opposite, underside or surface facing the attic space. The underside is reinforced by supports spaced throughout the length of the panel. Preferably, the underside also comprises rain baffles, also called weather blocks, located at points where precipitation or particulate may enter the ridge slot.

The vent of the present invention comprises a unitary panel defined by a length and width. The vent preferably has projections located at the length sides that can be joined to another succeeding length. The width terminates at external baffles at either end of the width. A center hinge located substantially at the topside and preferably integral with the panel divides the panel longitudinally. The center hinge is preferably embossed onto the unitary panel.

Louver portions at the width ends can comprise rows of slots and slats running parallel to each other in transverse direction to the length of the partition. However, the louvers can be in a parallel direction to the length of the partition or in any other configuration that provides for the desired ventilation. The louver portions are discrete and independent to each partition defined by side baffle walls and an external baffle.

At the underside, located substantially at the internal end of the louver portion and on or adjacent to the side baffle walls, can be rain baffles. These rain baffles substantially prevent precipitation and particulate from infiltrating the vent. The underside also comprises multiple supports to reinforce the vent. The supports preferably have a nail boss for driving a nail through. Every number of supports, the number of which is predetermined prior to manufacture, preferably has a support peg and no nail boss. The nail boss can be adapted for use with a nail gun and can be countersunk from the topside.

Further, a baffled roll vent for covering a roof ridge slot is provided, the baffled roll vent comprising a first vent section having a male part and a second vent section having a female part, wherein the male part of the first vent section attaches to the female part of the second vent section.

The installation of the baffled roll vent comprises the steps of placing the spirally rolled baffled roll vent on the ridge of a roof with a ridge slot, uncoiling the baffled roll vent over the ridge slot, adjusting the position of the baffled roll vent so that the center hinge is substantially centered over the ridge slot, flexing from the center hinge the baffled roll vent downward so that side edges of the baffled roll vent substantially conform to the roof slope and tiles or shingles adjacent to the ridge slot, and fixing the baffled roll vent to the roof. Preferably, the vent is fixed by nailing through the nail bosses of the underside supports.

To completely cover the ridge slot at the peak of the roof, additional baffled roll vents can be used as needed and placed end-to-end with the previously installed baffled roll vent. The baffled roll vent preferably can be cut with known cutting implements to any desired length.

At the beginning and end of each panel, are weather flaps and melt tabs for aligning and joining the panel with a succeeding section.

Additionally, the baffled roll vent can be installed by placing a fibrous mat along the roof ridge parallel with the ridge slot so that the lower portion of the baffled roll vent covers the fibrous mat. The use of the fibrous mat prevents small particles from entering into the attic space through the slots of the louver. The fibrous mat can also be integrated with the baffled roll vent by known methods. Another method of installing the baffled roll vent for covering the ridge of a roof is provided, the method comprising providing a baffled roll vent comprising two or more vent sections, each vent section having one or more male part(s) and one or more female part(s), the male part(s) of one vent section being attached to the female part(s) of a next vent section in the baffled roll vent, positioning the baffled roll vent in a spirally-rolled configuration onto an end of a roof ridge, and detaching one vent section from the next vent section by detaching the one or more male part(s) of the one vent section from the one or more female part(s) of the next vent section.

DETAILED DESCRIPTION OF THE INVENTION

Figure 1:
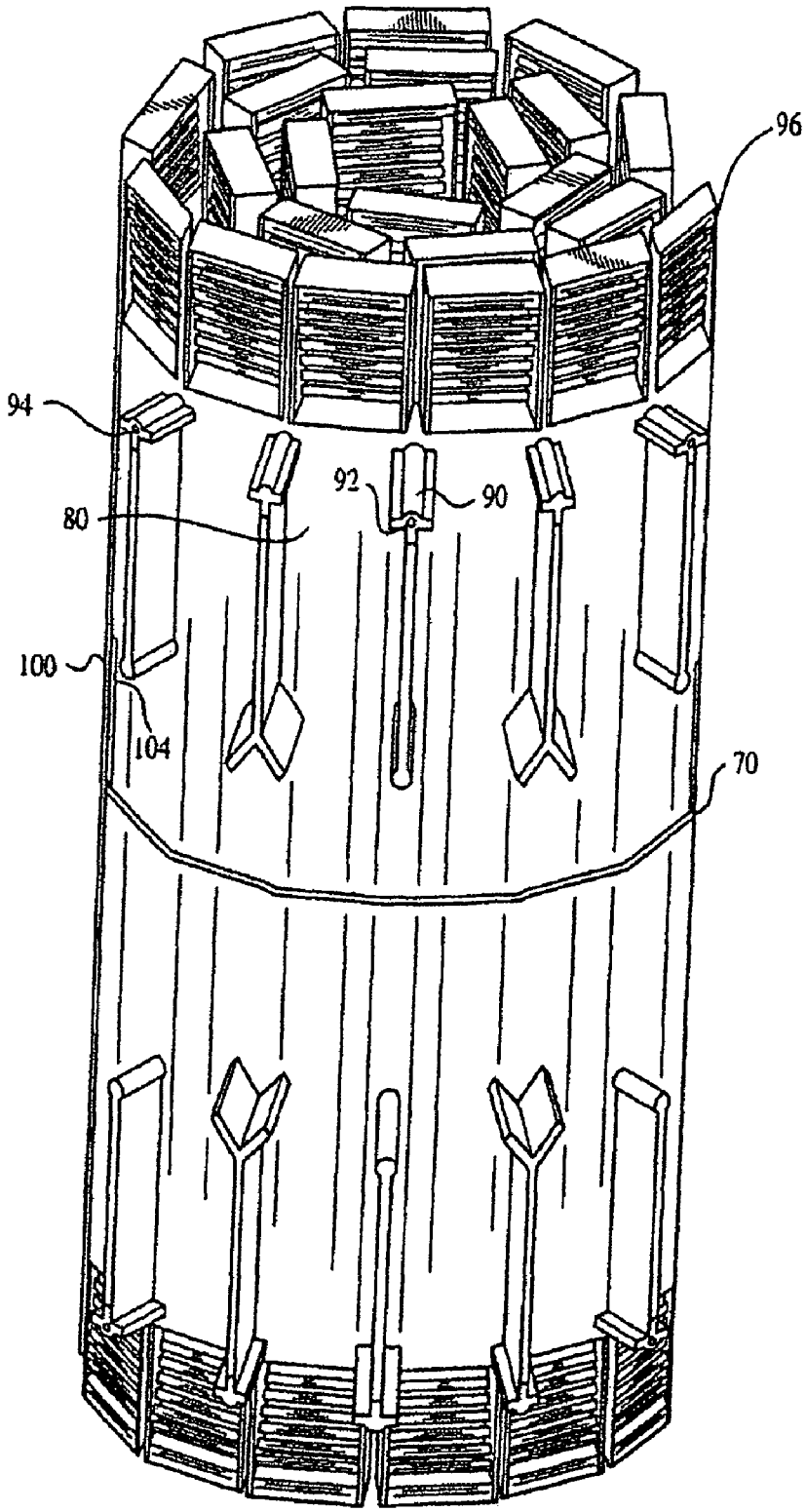
FIG. 1 is a perspective view of a baffled spirally rolled vent embodying the present invention.

FIG. 1 is a perspective view of the baffled roll vent of the present invention, generally designated by the numeral 100, in a spirally-rolled configuration made from a water proof, flexible material, preferably of polymers that include, but are not limited to, natural and synthetic rubbers, polyester, polystyrene, polyethylene, high impact styrene and copolymers and/or blends thereof.

Figure 2:
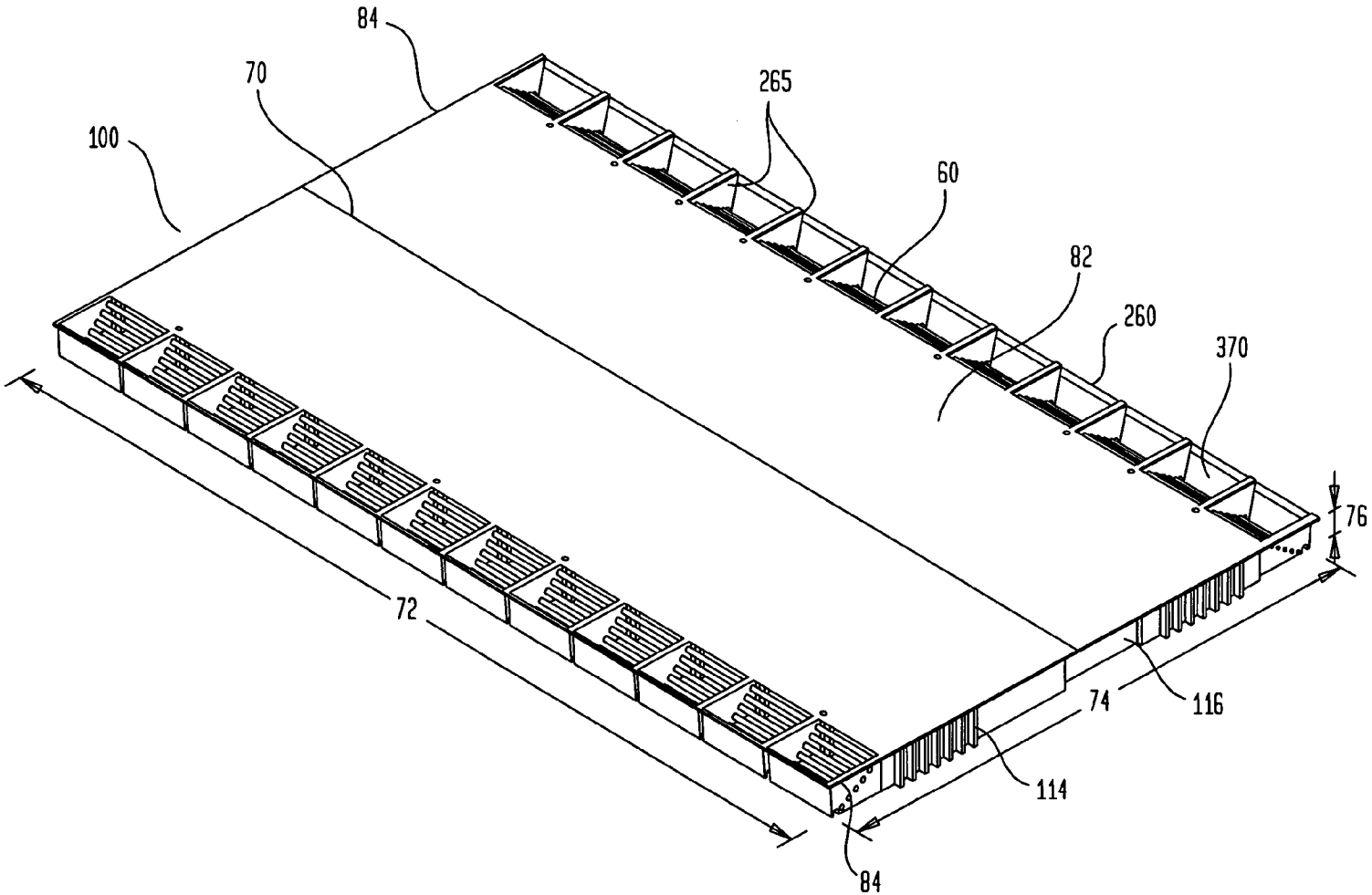
FIG. 2 is a perspective view of the baffled roll vent in a straight, unrolled configuration.

In FIGS. 1 and 2 the baffled roll vent 100 comprises a topside 60 and an underside 80. The vent preferably comprises a unitary panel 82. The panel comprises a center hinge 70 that is preferably soft and located at or near the topside 60 but can be located substantially at the underside 80. The hinge 70 offers resistance that provides for bending pressure easily produced by a user to effectively bend the vent to coincide with the slope of the roof. However, the hinge 70 substantially retains its memory so that upon release of the external force they substantially return to their original shape or configuration. The center hinge 70 is preferably embossed onto the topside 60 of the panel.

As best seen in FIG. 2, each panel is preferably of an elongated rectangular configuration defined by length 72, width 74, and height 76 from underside 80 to topside 60. The size of the length 72 is preferably from about 2 feet to 20 feet, and most preferably from about 4 feet to 5 feet, while the width 74 is from about 5 inches to 15 inches, preferably 7 inches to 13 inches, and most preferably from 8 inches to 12 inches. The length 72 terminates at length end edges 84. The width 74 terminates at discrete and independent louver portions 370 comprising an external baffle 260 and side baffles 320.

Figure 3A:
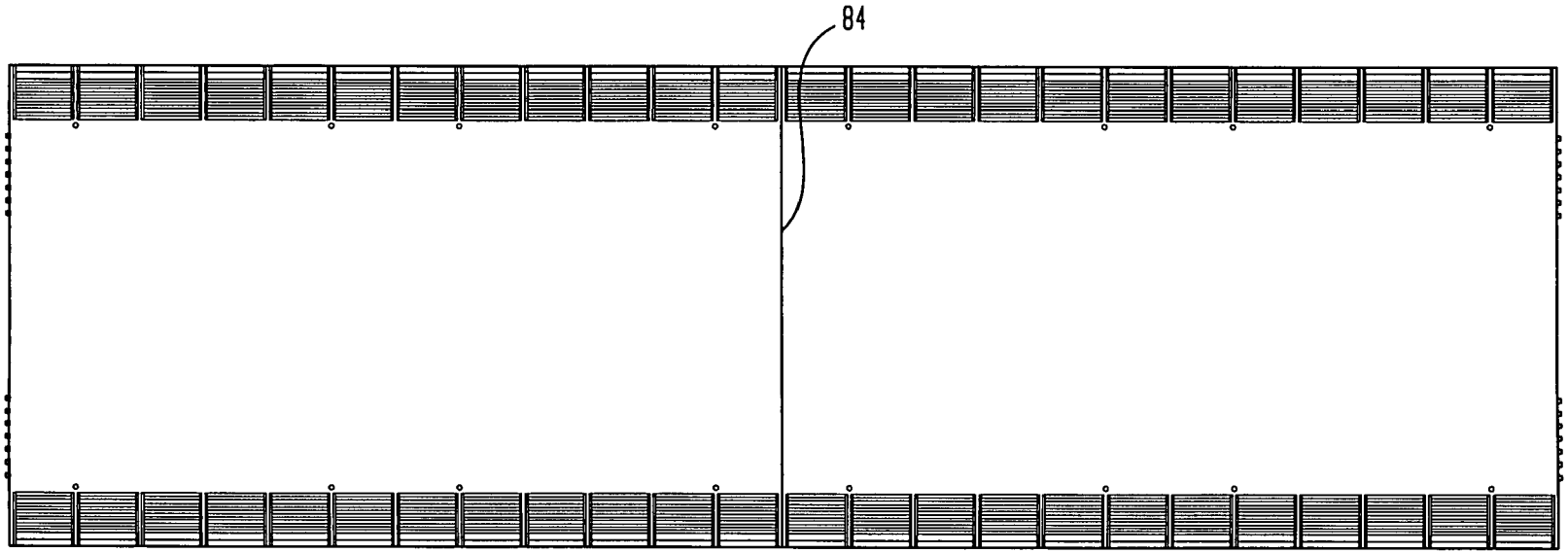
FIG. 3*a* is a top plan view of the baffled roll vent in a straight, unrolled configuration.
Figure 3B:
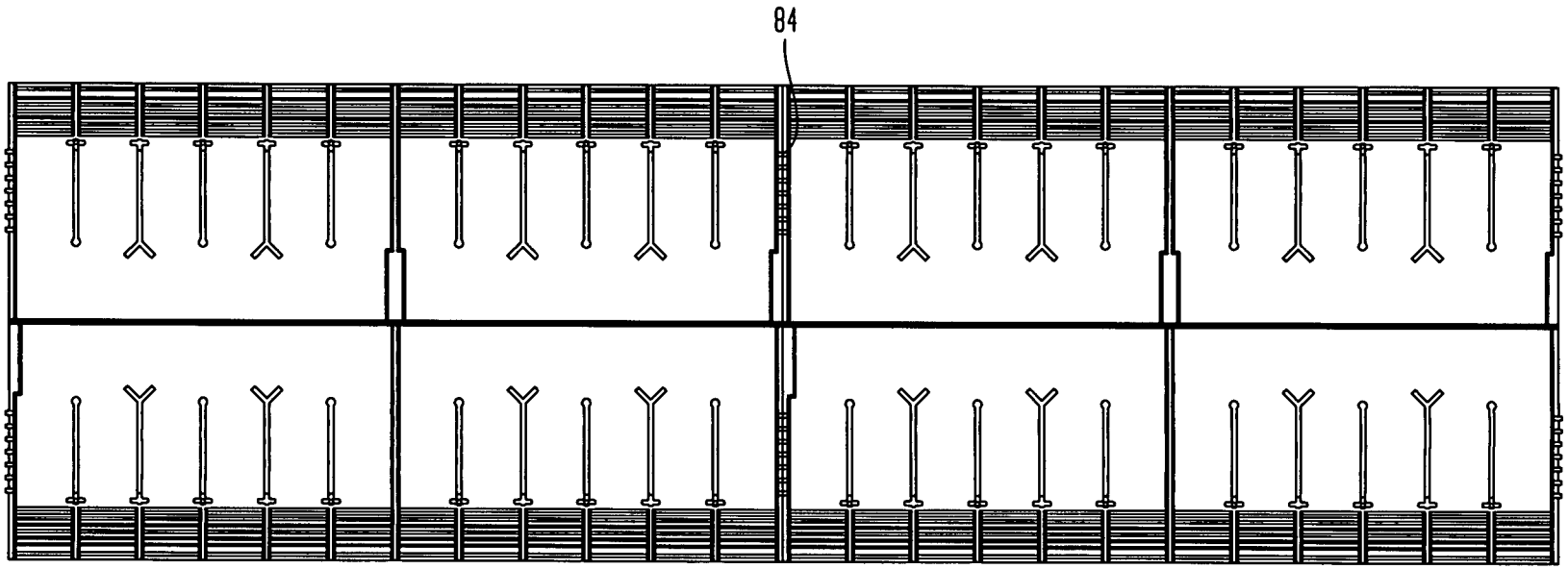
FIG. 3*b* is an underside plan view of the baffled roll vent in a straight, unrolled configuration.

As shown in FIGS. 3A and 3B, the length edges 84 can be butt welded or molded together in succeeding sections or the panels may be indexed in a continuous operation to form preferably 5 feet to 40 feet continuous lengths and most preferably 20-25 foot lengths. These lengths are spirally rolled for packaging and shipping. FIG. 2 additionally shows the length end edges 84 with melt tabs 114. The length end edge 84 comprises the edge of the unitary panel 82 as well as an end barrier 116 that depends downward from the unitary panel 82. The end barrier 116 is broken or split the length of its height at the center hinge 70, to provide flexibility and coverage when fixing the vent to the slope of the roof. The end barrier 116 substantially prevents precipitation and particulate from getting under the vent from the length ends.

The louver portions 370 are each discrete from the other and comprise side baffles 320, the external baffle 260, and slats 380. The width of the louver portion 370 is preferably about 1 inch to 4 inches, and most preferably about 2-3 inches measured from end baffle 260 to the end of the slats 380. The length is preferably about 0.25" to 3", and most preferably about 1" to 2" measured from side baffle to side baffle. The side baffles 320 have a height of preferably about 0.5 inches to 2 inches or equal to the height of the partition 120.

The louver portion 370 preferably can have tapered side baffles 320 and external baffle 260 that gradually decrease in width from the topside 60 towards the underside 80 to help facilitate removal from molds during manufacturing if the vent is molded.

The slats 380 of the louver portion 370 preferably extend from side baffle to side baffle and are provided from the underside 80 to the topside 60 at an angle of preferably about 15° to 95°, and most preferably about 30° to 45°. The slats 380 provide for the ventilation of gases and moisture from below the roof ridge.

Figure 4:
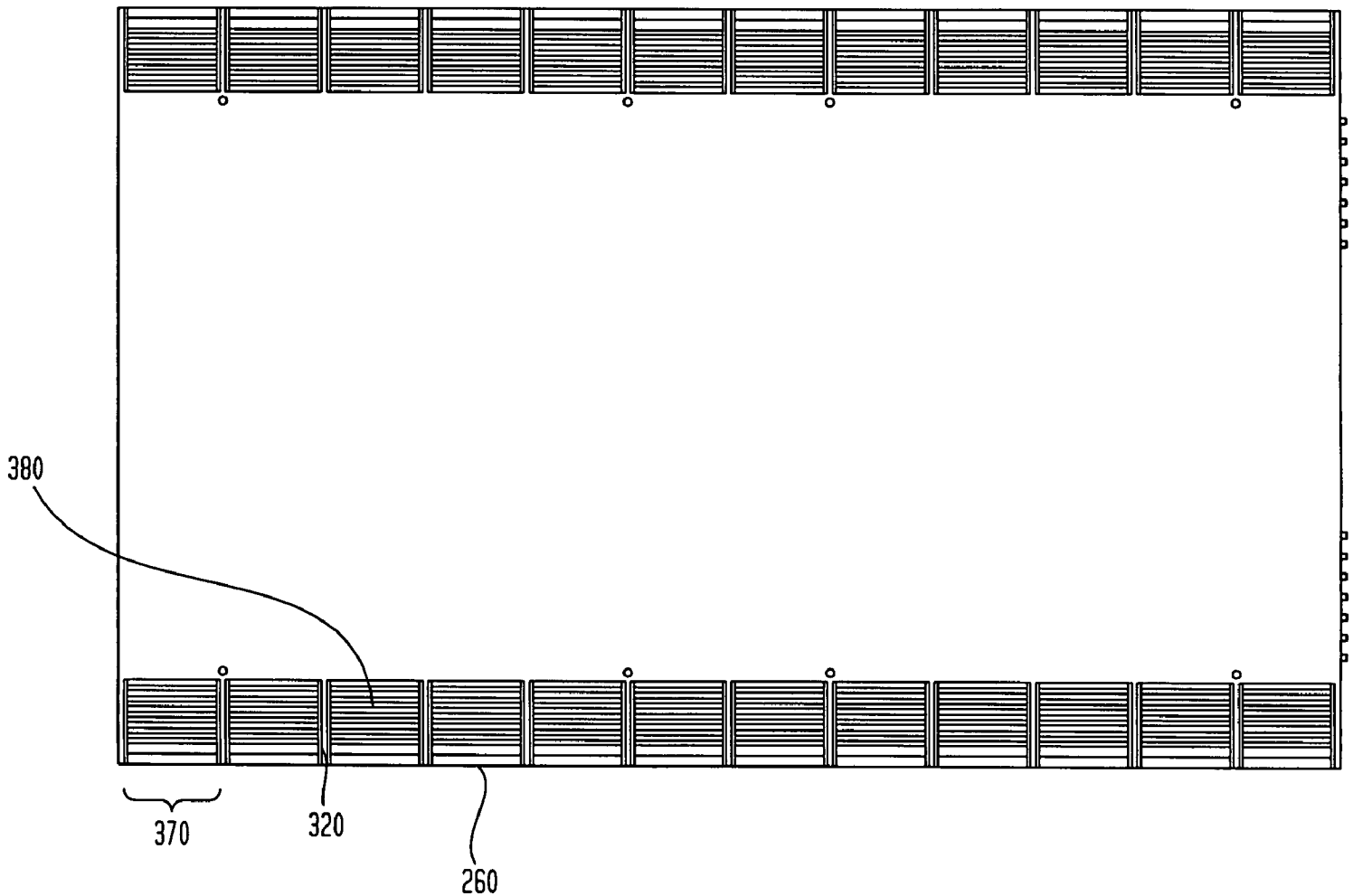
FIG. 4 is a top plan view of the baffled roll vent in a straight, unrolled configuration.
Figure 5:
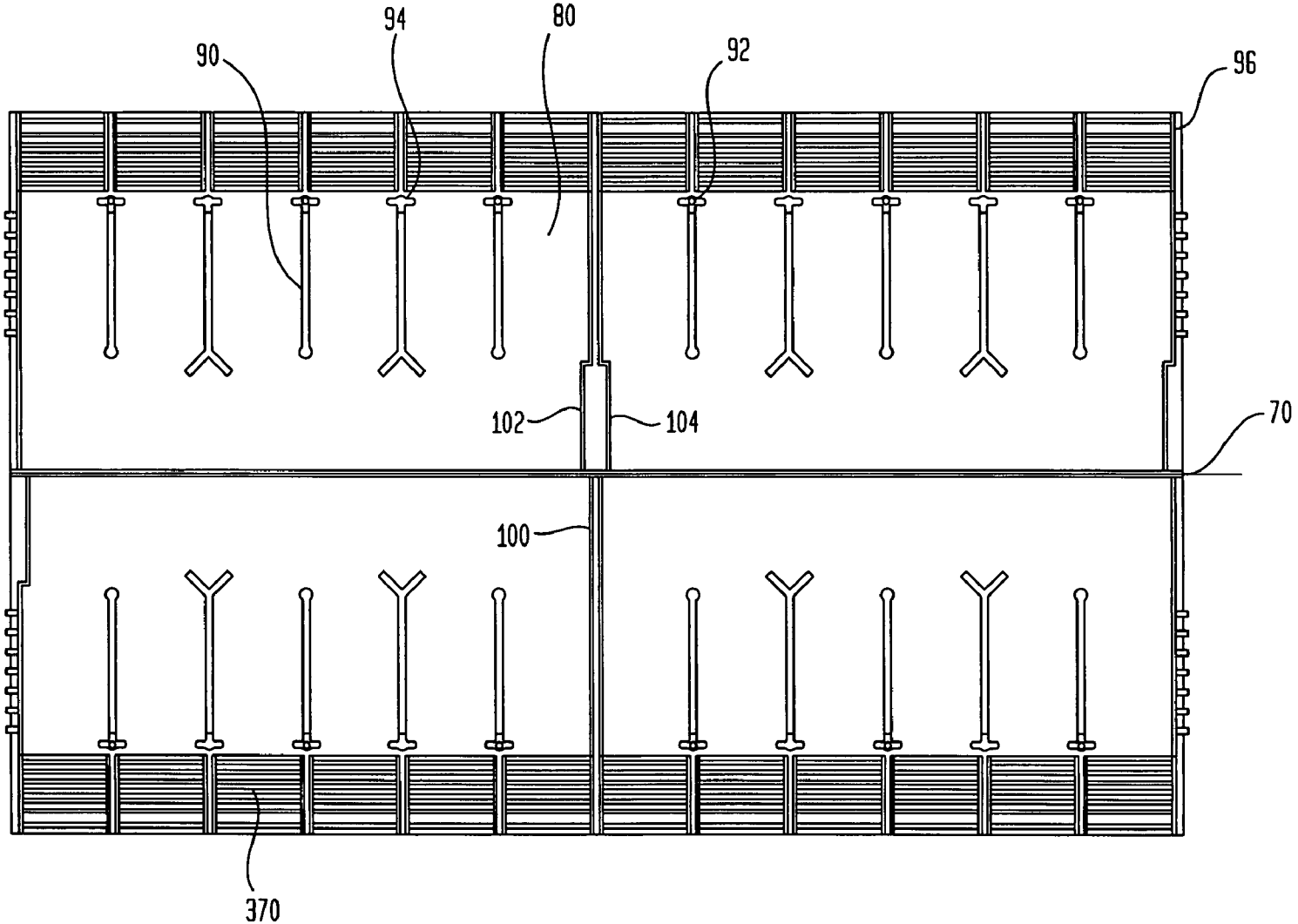
FIG. 5 is a second underside plan view of the baffled roll vent as a single panel in a straight unrolled configuration.

FIG. 5 is a plan view of the underside 80 of FIG. 4. FIG. 5 shows the underside 80 of the baffled roll vent panel that faces the ridge slot and space below the vent. Multiple supports 90 are used to prevent sagging or collapse of the vent and provide for adequate air circulation from the ridge slot to the outside environment. These supports 90 are preferably "I" or "Y" shaped braces but are not limited to such shapes. Every several support 90 can have a nail boss 92 at its end closest to the louver portion 370, which is a passage through a support from the topside 60 to the underside 80. The nail boss 92 provides support and housing for a nail that can be used to fix the vent to a roof. The nail may be preinserted into the nail boss 92 from the topside 60 prior to installation. Pegs 94 may also be placed on a support 90 for additional support. Pegs 94 may further act as rain baffles for blocking rain and other elements from entering under the roll vent.

Figure 9:
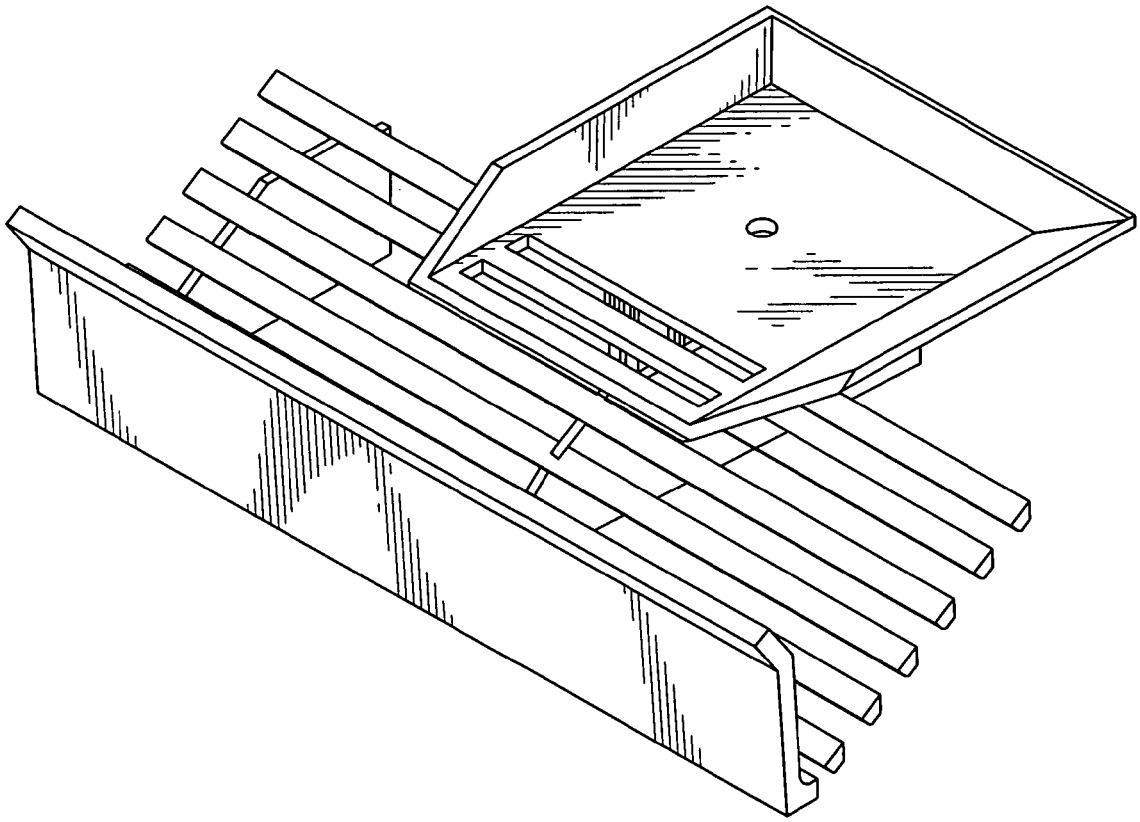
FIG. 9 is an isolated view of the baffled roll vent adapted for use with a nail gun.

The nail boss 92 may also be adapted to receive a nail from a nail gun as shown in FIG. 9. This embodiment can provide for a countersunk or recessed nail hole at the topside 60. Preferably, the recessed area substantially conforms to accept the base (where the nail exits the gun) of most commercially available nail guns. Also preferably, the recessed area has a tapered side that provides for the base of the nail gun to slide into the area. Opposite the tapered side is a substantially vertical wall that stops the sliding of the nail gun and aligns the base at the intended position on the vent. Beneath the recessed area is the nail boss, which in this embodiment is preferably reinforced compared to a non-nail gun embodiment. The reinforcement provides for crush resistance and nail support.

The embodiment shown in FIG. 9 shows the recessed area as thickened section of the unitary panel. This can be accomplished by molding a recessed area onto the unitary panel rather than incorporating the recessed area directly into the unitary panel. This type of thickened nailing zone provides for greater holding power of cap shingle nails that in turn provides for more securely attaching the cap shingles to the roof. The thickened plastic area will offer greater holding strength on the nail shank than the more thin area of the top unitary panel. There will be more surface area (thickness) of the top panel on the nail shank which helps to hold the nail in conjunction with the tip of the nail embedded into the plywood decking.

FIG. 5 also shows drain holes 96 that can be placed in the length end edges 84 providing for drainage of precipitation accumulating under the vent 100. Preferably, the underside can comprise weather flaps that provide additional support and edge closure for when a length is cut to size at installation. To provide for the desired rolled configuration, the weather flaps can be straight flaps 100 from the external baffle 200 to the center hinge 70 opposite left and right cornered flaps 102, 104 respectively. Also, the weather flaps can comprise rain baffles.

Figure 6A:
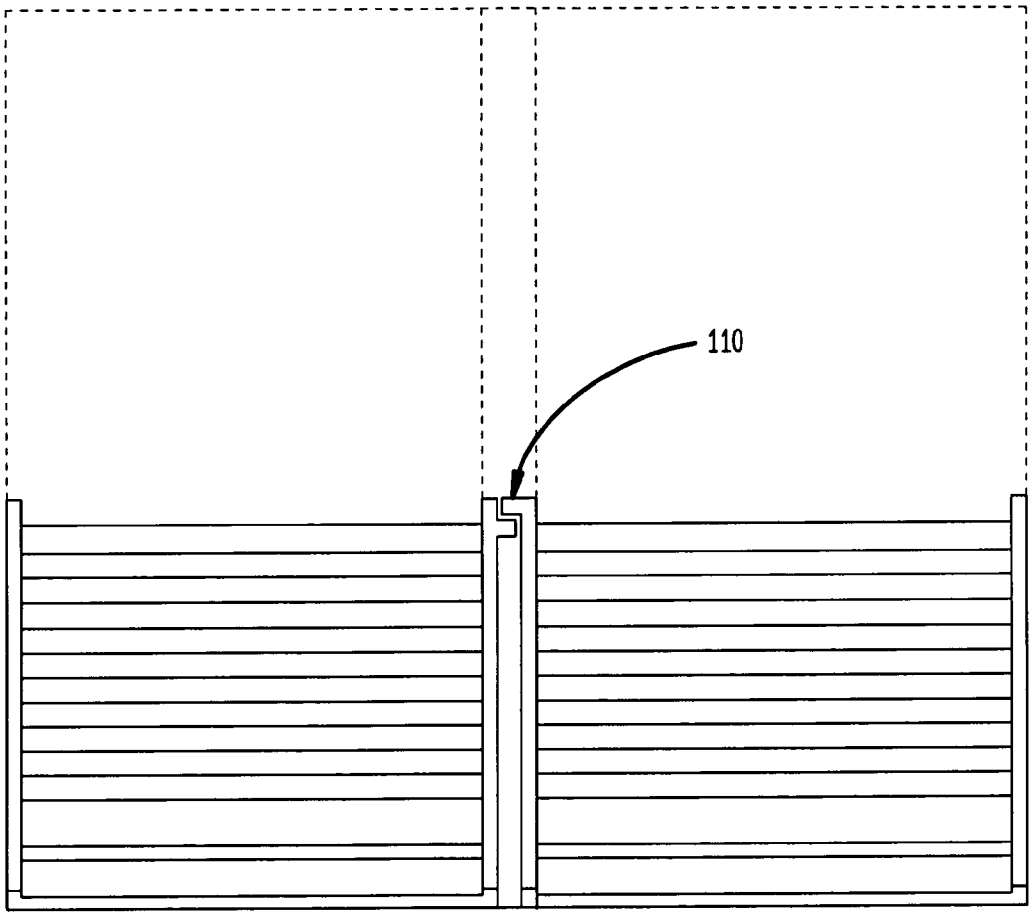
FIGS. 6*a*-6*d* are detailed underside plan views of embodiments of the baffled roll vent.
Figures 6B, 6C, 6D:
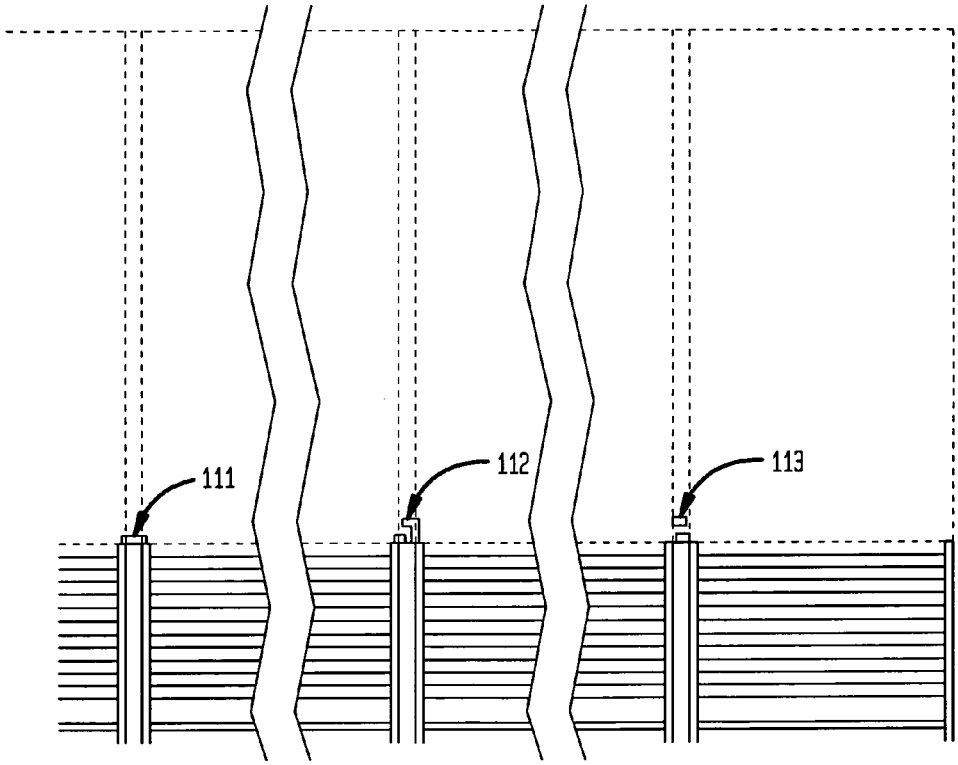

FIG. 6*a* shows overlapping rectangular and "L" shaped rain baffles integral with the side baffle walls. These rain baffles substantially prevent precipitation and particulates from entering the ridge slot. Further embodiments of rain baffles are shown in FIGS. 6*b*-6*d*. FIG. 6*b* shows a single rain baffle 111 blocking the passage formed between side baffle walls. FIG. 6*c* shows an "L" shaped baffle along with a peg baffle 112 that works in conjunction to substantially prevent the flow of rain. FIG. 6*d* shows two overlapping pegs 113. These and other rain baffle embodiments are made possible in the present invention.

Figure 7:
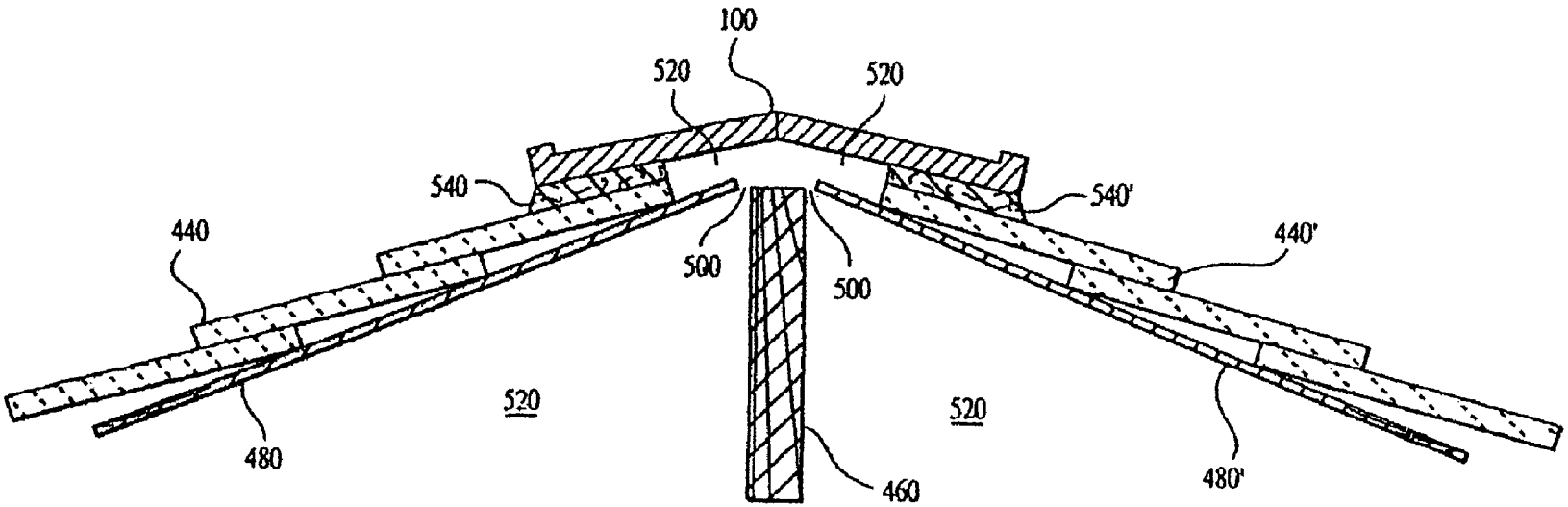
FIG. 7 is a cross-sectional view of the baffled roll vent installed on a roof ridge.

FIG. 7 is a cross-sectional view of the baffled roll vent installed on a roof ridge. The baffled roll vent 100 is described in relation to a sloped roof covered with roof tiles 440 and 440' overlapping each other. The tiles 440, 440' direct the flow of precipitation from the roof ridge downward. The sloped roof comprises a ridge board 460 to which the rafters are attached (not shown); plywood or some other decking or sheathing 480 and 480'; and roof tiles or shingles 440 and 440' laid over the sheathing. The plywood decking 480, 480' and covering roof tiles 440, 440' do not completely cover the roof. At the ridge of the roof there is a ridge slot 500 that serves as an exit for air from the attic space 520 or any space under the ridge slot. The ridge slot 500 defines a space at the peak of the roof so that the air below can be vented to the outside. While the ridge slot 500 provides for ventilation of this space, it also allows entry of rain, snow, insects and debris to enter into the space. To prevent such entry, the ridge vent covers the ridge slot 500 and overlaps the plywood deck and tiles of the roof. The overlap helps ensure that precipitation and other elements do not enter the attic space. The baffled roll vent 100 is secured to the ridge board and/or roof deck by roofing nails, adhesives or other appropriate securing means known in the art.

The baffled roll vent 100 is preferably used with a mat of fibrous material 540 and 540' that can be of randomly oriented synthetic, air-permeable fibers with varying mesh sizes. The synthetic fibers, such as made by nylon and polyester are randomly aligned into a web. The thickness of the mat typically is of from about 0.5 to 3 inches. The air-permeable mat 540, 540' can be cut into strips the length and width of which is determined by the length and width of the baffled roll vent for which the strip is used. The mat 540, 540' can be placed on roof tiles 440 and 440' and underneath louver portion 370. Alternatively, the mat 540, 540' may be integrated to the baffled roll vent 100 during manufacture or post-manufacture by any known method including, but not limited to, adhesively fixing, using burrs or by hooking the mat with hooks integral with the baffled roll vent 100.

The process of installing the baffled roll vent 100 includes the steps of placing the spirally-rolled vent 100 over the ridge slot 500 of the roof ridge; uncoiling the baffled roll vent 100 on the ridge slot 500 of the ridge; flexing the baffled roll vent at a center hinge to conform to the roof; and fixing the baffled roll vent 100 to the roof. Nails, screws, hooks, rivets or adhesives or any other known method can fix the baffled roll vent 100 to the roof. Further, a fibrous mat 540, 540' can be placed along the roof ridge adjacent to the ridge slot 500 prior to placing the spirally rolled vent 100 over the ridge slot 500.

Figure 8:
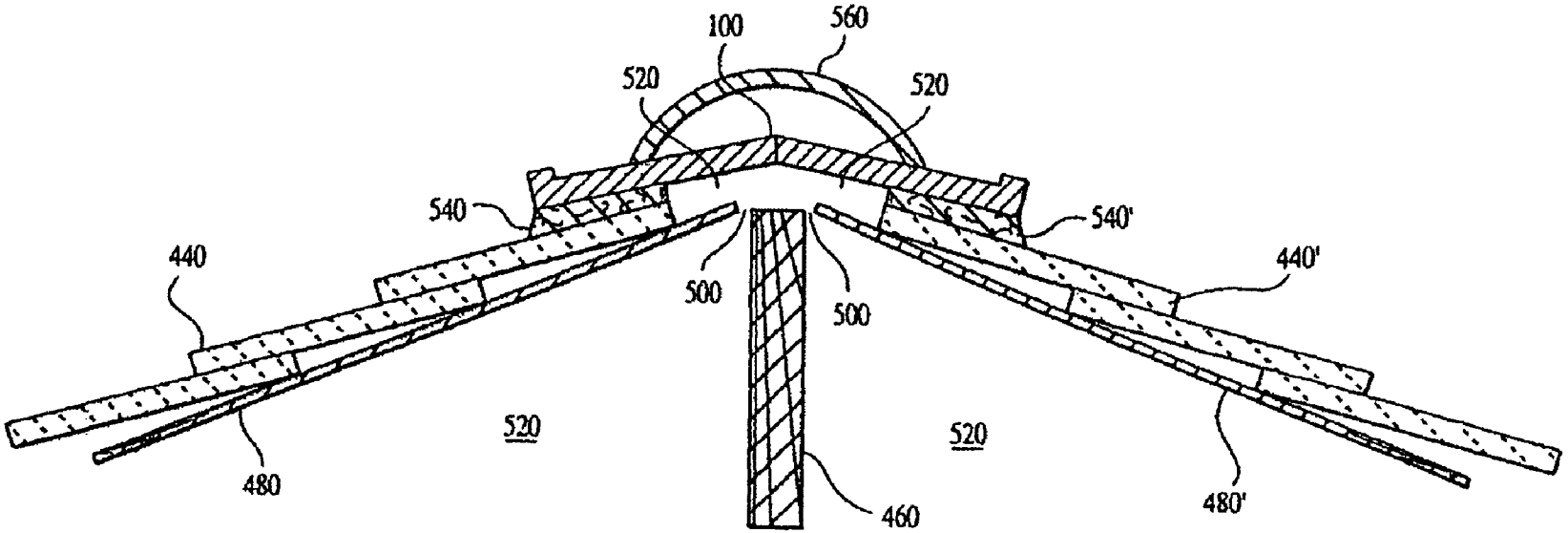
FIG. 8 is a cross-sectional view of the baffled roll vent and an end cap installed on the roof ridge.

An end cap 560 can cover the baffled roll vent as shown in FIG. 8. The end cap 560 is fixed to the roof over the baffled roll vent 100 with traditional means including, but not limited to, nails, screws or adhesives.

Figure 10:
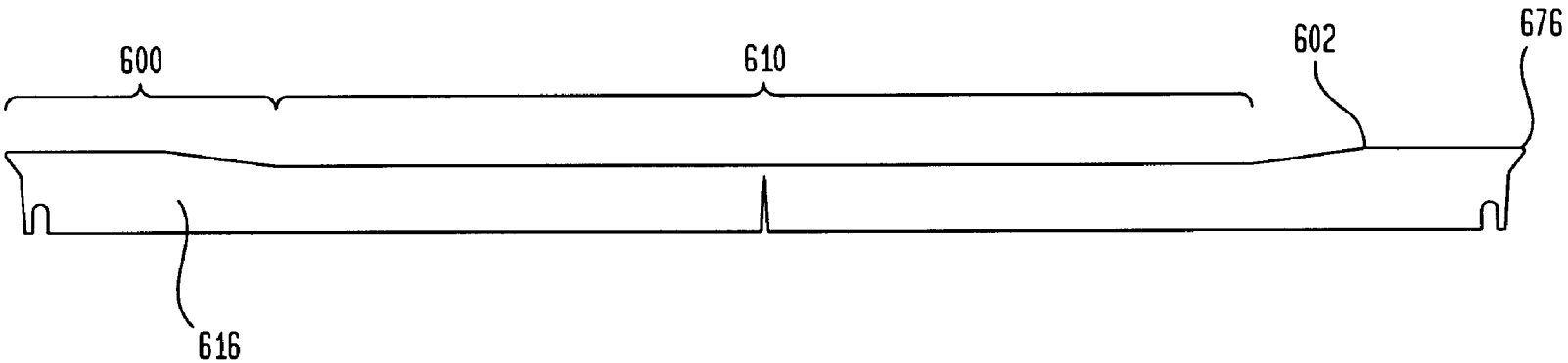
FIG. 10 is a plan view of a further embodiment of the baffled roll vent of the present invention.
Figure 11:
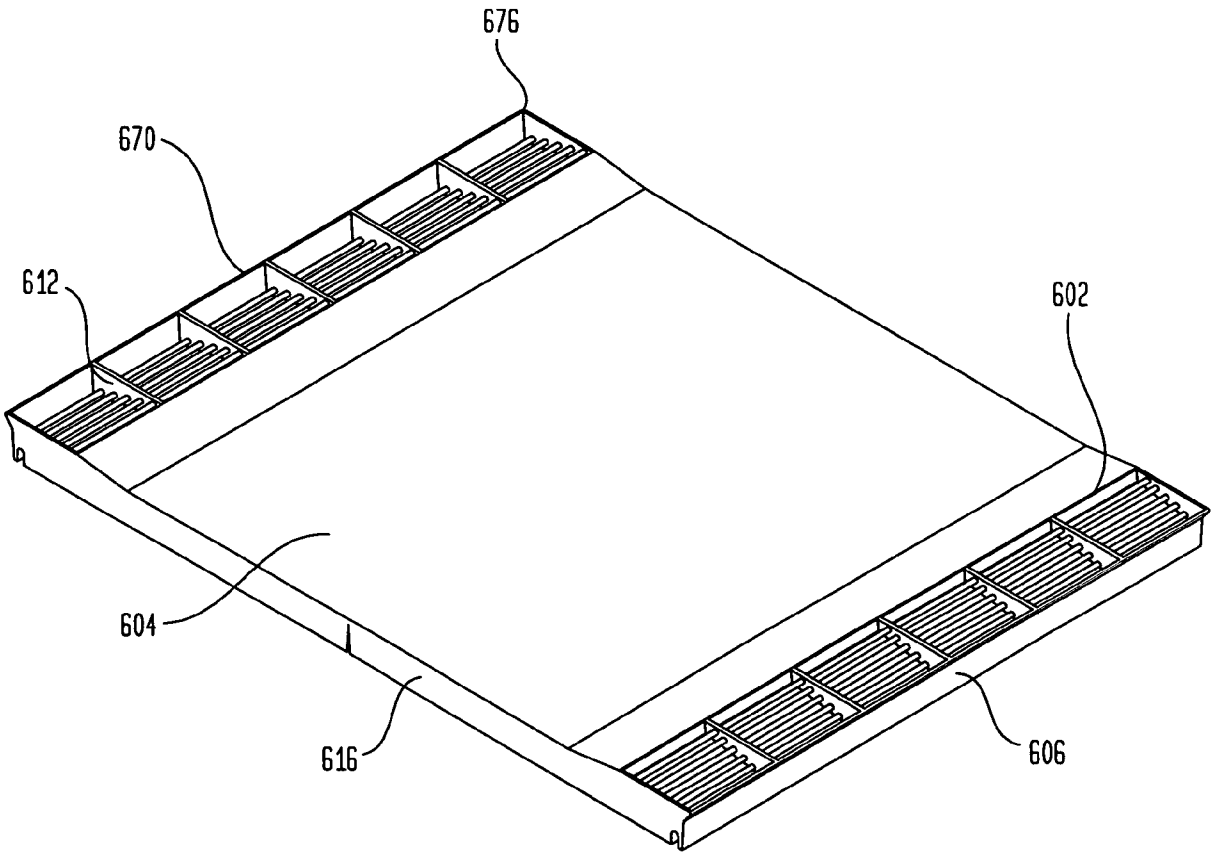
FIG. 11 is a top perspective view of the baffled roll vent.

In FIG. 10 a side view shows the present-invention with a raised baffle area 600 relative to the center portion 610 of the unitary panel. The top perspective view of this embodiment is depicted in FIG. 11. In this embodiment the louver portions 670 begin at a greater height 676 and extend downwards to be substantially level with the bottom of the end barrier 616. At the inside edge 602 of the louver portions 670, the unitary panel 604 slopes downward toward the center of the panel. This creates the raised baffle area 600 including the, louver portions 670 and the sloping portion of the unitary panel 604 and a lower center portion of the unitary panel 610. The panel may have a center hinge allowing it to flex in conformity to the slope of a roof ridge.

By creating a lower center portion and raised baffle area the invention is able to increase the net free area of the vent. "Net Free Area" or NFA means the cross-sectional area of a ventilator system which is open for passage of air there through. This embodiment also provides for better application with a nail gun. The lower center portion is preferably ⅝ inches in height providing for a fastener from a nail gun to fully penetrate into the roofing substrates below the vent.

The unitary panel 604 extends laterally between the louver portions 670 and is integral with the external baffle 606. This creates discreet but semi-independent louver portions substantially enclosed by the unitary panel 604. The end baffle 606 is preferably a unitary baffle extending the length of the panel. Side baffles 612 extend downward from the unitary panel 604 between the louver portions 670 at a length substantially equal to the panel's height.

Figure 12:
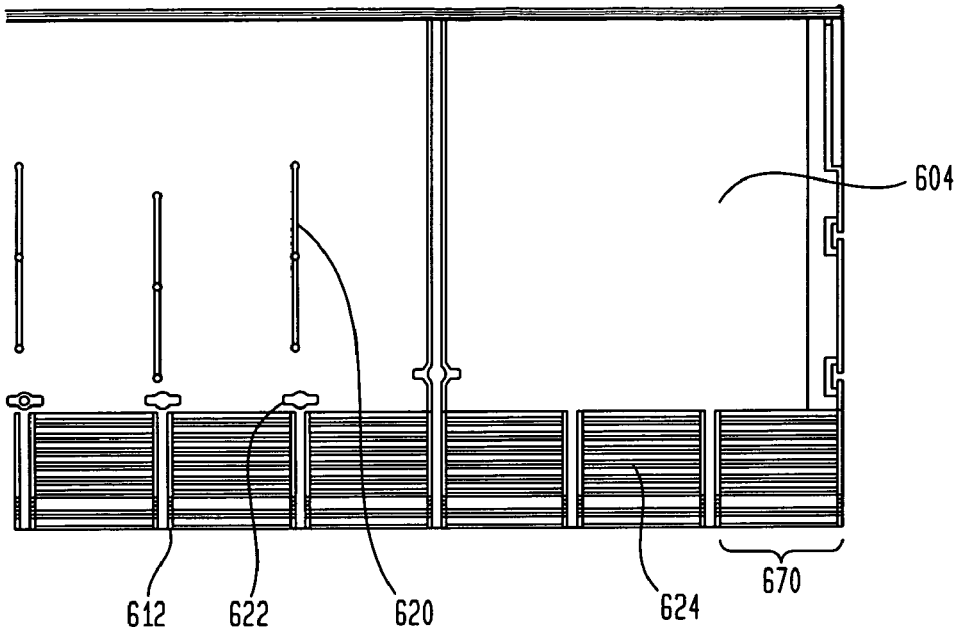
FIG. 12 is a bottom plan view of the baffled roll vent.

The underside of the invention may be of the embodiment partially shown in FIG. 12. This figure shows multiple supports 620 extending downward from the unitary panel 604 that may be "I" or "Y" shaped but are not limited to such shapes. These supports may have nail holes but in this embodiment they do not. Instead, this embodiment has independent support pegs 622 that may act as a nail boss. The independent support pegs 622 also can act as weather blocks. The multiple supports 620 do not extend to the louver portion 670 and generally end at or within the sloping portion.

The side baffles 612 are shown in FIG. 12 depending from the unitary panel 604 and fixed to the slats 624 of the louver portions 670. Also shown in FIG. 12 are connecting means for connecting a series of vent panels to each other.

Figure 13:
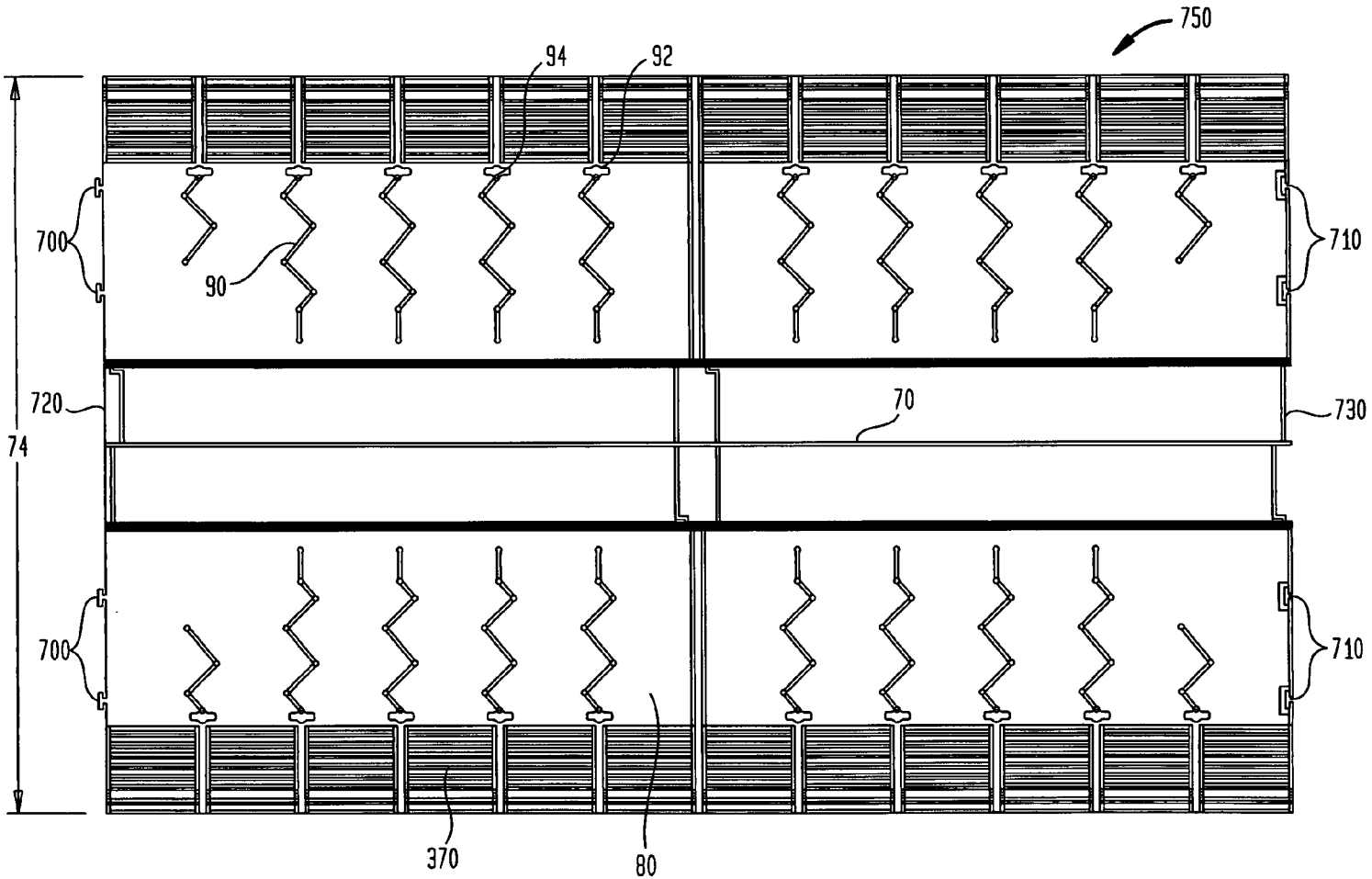
FIG. 13 is an underside plan view of a vent section of the baffled roll vent in a straight unrolled configuration.

FIG. 13 is another type of plan view of an underside 80 of a baffled roll vent 100 of the present invention. FIG. 13 shows a vent section 750 of the baffled roll vent panel 100. Several vent sections 750 can make up the entire baffled roll vent 100. Similar to FIG. 5, multiple supports 90 can be used to prevent sagging or collapse of the vent and provide for adequate air circulation from the ridge slot to the outside environment, and can be "I" or "Y" shaped braces but are not limited to such shapes. Every several support 90 can have a nail boss 92 at its end closest to the louver portion 370, which is a passage through a support from the topside 60 to the underside 80. The nail boss 92 provides support and housing for a nail that can be used to fix the vent to a roof. The nail may be preinserted into the nail boss 92 from the topside 60 prior to installation. Pegs 94 may also be placed on a support 90 for additional support. Pegs 94 may further act as rain baffles for blocking rain and other elements from entering under the roll vent.

Further, FIG. 13 shows a male interlock part 700 located on an edge 720 of vent section 750 and a female interlock part 710 located at an edge 730 of vent section 750. Preferably, as seen in FIG. 13, two male interlock parts 700 are used on an upper side of edge 720 and two male interlock parts 700 are used on a lower side of edge 720. Similarly, two female interlock parts 710 are used on an upper side of edge 730 and two female interlock parts 710 are used on a lower side of edge 730. These male and female interlock parts 700 and 710, respectively, are each placed substantially in the same location with respect to the width 74 on opposite edges 720 and 730 of vent section 750.

Preferably, male interlock parts 700 protrude from the edge 720 of vent section 750, and female interlock parts 710 are cut into or built into the edge 730 of vent section 750. As shown, the male interlock parts 700 are t-shaped and of a peg structure, and the female parts 710 are shaped as receptacles, but they are not limited to such structures. The shape of the male interlock parts 700 can be t-shaped, peg shaped, oval shaped, square shaped, round shaped, and the female interlock parts 710 will have a structure corresponding to or accommodating the male interlock parts 700, such as appropriate openings or receptacles. Any other type of geometry known for male-female connectors can be used and is not limited to the above. The shape of the male and female interlock parts are also designed so that it is easy to separate the vent sections 750 from each other, as well as to attach the vent sections 750 to each other.

In this manner, when each separate vent section 750 is rolled to form the baffled roll vent 100, the male interlock parts 700 of one vent section 750 line up with the female interlock parts 710 of another vent section 750, and lock together in place to keep the baffled roll vent 100 together.

As seen in FIG. 13, four male interlock parts 700 are used and four female interlock parts 710 are used. However, one male and female structure may be used, and more than four male and female structures may be used on each vent section 750, depending on the width 74 of the vent panel and the stability required. However many are used, they are preferably placed in a substantially equal interval on the edges 720 and 730 along the width 74 of the vent section 750.

More male interlock parts 700 and corresponding female interlock parts 710 can be used to provide more stability, with consideration given to cost, design, ease of manufacture and installation, etc. Such a structure of a baffled roll vent 100 provides a baffled roll vent that does not have to be cut or separated by the manufacturer or installer, but can be attached and/or broken into separate vent sections 750. No tools or cutting equipment are required.

Accordingly, it should be readily appreciated that the device and method of the present invention has many practical applications. Additionally, although the preferred embodiments have been illustrated and described, it will be obvious to those skilled in the art that various modifications can be made without departing from the spirit and scope of this invention. Such modifications are to be considered as included in the following claims.

What is claimed is:

1. A baffled roll vent for covering a roof ridge slot, comprising:

a first vent section having a male part; and a second vent section having a female part;

wherein the male part of the first vent section attaches to the female part of the second vent section;

wherein each of the first vent section and the second vent section has a topside and an underside, wherein said underside includes a fibrous material integrated therewith, and wherein each of the first and second vent section has a width terminating at discrete and independent louver portions, each discrete and independent louver portion comprising an external baffle, slats, and side baffles having a raised height relative to a center portion of said vent sections; and wherein the first vent section and the second vent section each have a center hinge, wherein each vent section flexes at its center hinge.

2. The baffled roll vent of claim 1, wherein the first and second vent sections are defined by a length and a width.

3. The baffled roll vent of claim 2, wherein the width is between five inches to fifteen inches.

4. The baffled roll vent of claim 2, wherein the width is between seven inches to thirteen inches.

5. The baffled roll vent of claim 2, wherein the width is between eight inches to twelve inches.

6. The baffled roll vent of claim 1, wherein the baffled rob vent is made from injection molding polymeric material.

7. The baffled roll vent of claim 6, wherein the polymeric material is selected from the group consisting of natural rubber, synthetic rubber, polyester, polystyrene, polyethylene, high impact polystyrene and copolymers and blends thereof.

8. The baffled roll vent of claim 1, wherein the baffled roll vent can be rolled into a spiral configuration.

9. The baffled roll vent of claim 1, wherein the male part is located on an edge of the first vent section and the female part is located on an edge of the second vent section.

10. The baffled roll vent of claim 1, comprising a female part on the first vent section; and a male part on the second vent section.

11. The baffled roll vent of claim 10, wherein the male part on the first vent section is located on an edge of the first vent section and the female part on the first vent section is located at an opposite edge of the first vent section.

12. The baffled roll vent of claim 11, wherein the male part on the second vent section is located on an edge of the second vent section and the female part on the second vent section is located at an opposite edge of the second vent section.

13. The baffled roll vent of claim 10, wherein the female part of the first vent section attaches to a male part of a third vent, section, and the male part of the second vent section attaches to a female part of a fourth vent section.

14. The baffled roll vent of claim 13, wherein the first, second, third and fourth vent sections make up the baffled roll vent and can be rolled into a spiral configuration.

15. The baffled roll vent of claim l, further comprising:

a second male part on the first vent section; and a second female part on the second vent section;

wherein the first and second mate parts of the first vent section attach to the first and second female parts of the second vent section, respectively.

16. The baffled roll vent of claim 1, wherein the male part is a male interlock peg and the female part is a female interlock receptacle adapted to receive the male interlock peg.

17. The baffled roll vent of claim 1, wherein the male part protrudes from the first vent section and the female part is an opening adapted to receive the male part.

18. A method of installing a baffled roll vent for covering the, ridge of a roof having an opening therein, the method comprising the steps of:

a) providing a baffled roll vent comprising two or more vent sections, each of said vent sections having a topside and an underside, wherein said underside includes a fibrous material integrated therewith, each vent section having one or more male part(s) and one or more female part(s), the male part(s) of one vent section being attached to the female part(s) of a next vent section in the baffled roll vent; each vent section having a width terminating at discrete and independent louver portions, each discrete and independent louver portion comprising an external baffle, slats, and side baffles having a raised height relative to a center portion of said vent sections; and wherein the baffled roll vent has a center hinge;

b) positioning the baffled roll vent in a spirally-rolled configuration onto an end of a roof ridge;

c) uncoiling the baffled roll vent to cover a roof ridge slot located at the roof ridge;

d) adjusting the uncoiled baffled roll vent so that the center hinge of the baffled roll vent is substantially at the ridge of the roof;

e) flexing the baffled roil vent at its center hinge to conform with the slope of the roof;

f) detaching one vent section from the next vent section by detaching the one or more male part(s) of the one vent section from the one or more female part(s) of the next vent section; and g) fixing the baffled roll vent to the sloped roof.

19. The method of claim 18, wherein the one or more male part(s) of each vent section are located at one edge of each vent section and the one or more female part(s) are located at an opposite edge of each vent section.

20. The method of claim 18, wherein the male part is a male interlock peg and the female part is a female interlock receptacle adapted to receive the male interlock peg.

* * * * *